US011174761B1

(12) United States Patent
Fanzani et al.

(10) Patent No.: US 11,174,761 B1
(45) Date of Patent: Nov. 16, 2021

(54) VARIABLE CAMSHAFT TIMING (VCT) PHASER ASSEMBLY AND CONTROL VALVE INSTALLED REMOTELY

(71) Applicant: BorgWarner Inc., Auburn Hills, MI (US)

(72) Inventors: Augusto Fanzani, Gessate (IT); Davide Caldirola, Besana Brianza (IT)

(73) Assignee: BORGWARNER, INC., Auburn Hills, MI (US)

( * ) Notice: Subject to any disclaimer, the term of this patent is extended or adjusted under 35 U.S.C. 154(b) by 0 days.

(21) Appl. No.: 16/875,039

(22) Filed: May 15, 2020

(51) Int. Cl.
*F01L 1/34* (2006.01)
*F01L 1/344* (2006.01)

(52) U.S. Cl.
CPC ... *F01L 1/3442* (2013.01); *F01L 2001/34426* (2013.01)

(58) Field of Classification Search
CPC ..... F01L 1/3442; F01L 2001/34426
See application file for complete search history.

(56) References Cited

U.S. PATENT DOCUMENTS

| | | | | |
|---|---|---|---|---|
| 6,453,859 | B1 | 9/2002 | Smith et al. | |
| 6,748,912 | B2 * | 6/2004 | Simpson | F01L 1/34 123/90.17 |
| 6,966,289 | B1 | 11/2005 | Butterfield | |
| 6,971,354 | B1 | 12/2005 | Smith et al. | |
| 7,255,077 | B2 | 8/2007 | Simpson et al. | |
| 7,942,120 | B2 | 5/2011 | Zhou | |
| 8,893,677 | B2 | 11/2014 | Smith | |
| 9,046,013 | B2 | 6/2015 | Lichti | |
| 2013/0068975 | A1 * | 3/2013 | Kondo | F16K 31/0613 251/129.01 |
| 2019/0003348 | A1 | 1/2019 | Smith | |
| 2019/0107014 | A1 | 4/2019 | Smith | |

* cited by examiner

*Primary Examiner* — Zelalem Eshete
(74) *Attorney, Agent, or Firm* — Reising Ethington P.C.

(57) ABSTRACT

A variable camshaft timing (VCT) phaser assembly and control valve are employed for use in an internal combustion engine. The VCT phaser assembly has a housing and a rotor. The control valve is installed at a location that is remote of the housing and rotor, and apart from a center bolt site of the housing and rotor. The control valve has a valve housing and a spool located in the valve housing. The valve housing has different ports for fluid communication with a source, an advance line, and a retard line. One or more recirculation paths can be established at various times between the valve housing and the spool, depending upon the position of the spool in the valve housing.

18 Claims, 7 Drawing Sheets

VARIABLE CAMSHAFT TIMING (VCT) PHASER ASSEMBLY AND CONTROL VALVE INSTALLED REMOTELY

TECHNICAL FIELD

The present application relates to variable camshaft timing (VCT) technologies equipped in internal combustion engines.

BACKGROUND

In automobiles, internal combustion engines (ICEs) use one or more camshafts to open and close intake and exhaust valves in response to cam lobes selectively actuating valve stems as the camshaft(s) rotate and overcome the force of valve springs that keep the valves seated. The shape and angular position of the cam lobes can impact the operation of the ICE. In the past, the angular position of the camshaft relative to the angular position of the crankshaft was fixed. But it is now possible to vary the angular position of the camshaft relative to the crankshaft using variable camshaft timing (VCT) technologies. VCT technologies can be implemented using VCT devices (sometimes referred to as camshaft phasers) that change the angular position of the camshaft relative to the crankshaft. These camshaft phasers are often hydraulically-actuated.

In hydraulically-actuated VCT devices, valves are typically mounted centrally with respect to housing and rotor components of the VCT devices in order to regulate the flow of oil to and from the components. The valves are part of a larger center bolt assembly. The valve's mounting and its centrality offer convenient and efficient flow of oil among the valve and advance and retard chambers established by the housing and rotor components to carry out advance and retard functionalities of the VCT devices.

Furthermore, VCT devices are commonly of the torsional assist (TA) type or the camshaft torque actuation (CTA) type. In general, a TA VCT device uses source oil for advance and retard purposes, and hence low oil pressure at lower revolutions per minute (RPM) in the accompanying ICE can hinder performance. A CTA VCT device, on the other hand, relies on camshaft torque energy and uses recirculated oil that is internal to the VCT device for advance and retard purposes. Higher RPMs in certain ICEs, however, have been shown to produce reduced camshaft torque energy and, in turn, can hinder performance of CTA VCT devices. To address the shortcomings of the two types of VCT devices, the workings of each have been merged and incorporated into a single VCT device. At lower RPMs the VCT device can employ its CTA functionality, and at higher RPMs the VCT device can employ its TA functionality. The valves of these VCT devices are designed to be able to switch between the TA and CTA functions as needed, as well as to blend the functions of TA and CTA together for concurrent performance.

SUMMARY

In one implementation, a variable camshaft timing (VCT) phaser assembly may include a housing, a rotor, and a control valve. The rotor is situated within the housing. One or more advance chambers and one or more retard chambers can be established between the housing and rotor. The control valve may include a valve housing, a spool, a first recirculation path, a second recirculation path, and a remote installation structural interface. The valve housing has a first port residing therein, a second port residing therein, and a third port residing therein. The first port has fluid communication with a source. The second port has fluid communication with an advance line. The third port has fluid communication with a retard line. The spool is located within a bore of the valve housing and can move within the bore. The first recirculation path can be established between the valve housing and spool depending upon the position of the spool in the valve housing's bore. The second recirculation path can be established between the valve housing and spool depending upon the position of the spool in the valve housing's bore. The remote installation structural interface resides at an exterior of the valve housing. The remote installation structural interface provides installation of the control valve at a location of an engine structure and that is removed from the housing and rotor of the VCT phaser assembly.

In another implementation, a variable camshaft timing (VCT) control valve may include a valve housing, a spool, one or more recirculation check valves, and a remote installation structural interface. The valve housing has a first slot and multiple first holes in fluid communication with each other. The first slot resides at an exterior of the valve housing. The valve housing has a second slot and multiple second holes in fluid communication with each other. The second slot resides at the exterior of the valve housing. The valve housing has a third slot and multiple third holes in fluid communication with each other. The third slot resides at the exterior of the valve housing. The valve housing has a recirculation slot and multiple recirculation holes in fluid communication with each other. The recirculation slot resides at the exterior of the valve housing. The spool is located within a bore of the valve housing. The recirculation check valve(s) is situated at the spool. The remote installation structural interface resides at the valve housing's exterior. The remote installation structural interface provides installation of the VCT control valve at a location apart from a center bolt site of a VCT housing and a VCT rotor. The remote installation structural interface includes a seal situated at the valve housings exterior.

In yet another implementation, a variable camshaft timing (VCT) phaser assembly may include a housing, a rotor, and a control valve. The control valve may include a valve housing, a spool, one or more recirculation check valves, a second recirculation path, and a remote installation structural interface. The valve housing has a first port residing therein, a second port residing therein, and a third port residing therein. The first port has fluid communication with a source. The second port has fluid communication with an advance line. The third port has fluid communication with a retard line. The spool is located within a bore of the valve housing and can move within the bore.

DETAILED DESCRIPTION

Embodiments of a variable camshaft timing (VCT) phaser assembly 10 and a VCT control valve 12 are presented in the figures and detailed in this description. The VCT phaser assembly 10 and VCT control valve 12 are, in general, equipped in automotive internal combustion engine (ICE) applications. Unlike past VCT devices and their valve components, the VCT control valve 12 is installed at a location in the accompanying ICE that is somewhat remote of a VCT housing and rotor, and that is removed from a center bolt site of the VCT housing and rotor. The VCT control valve 12 is capable of carrying out torsional assist (TA) and camshaft torque actuation (CTA) phasing functionalities distinctly and concurrently. Further, as used herein, the terms axially, radially, and circumferentially, and their related grammatical forms, are used in reference to the generally circular and cylindrical shape of the shown control valve and some of its components. In this sense, axially refers to a direction that is generally along or parallel to a central axis of the circular and cylindrical shape, radially refers to a direction that is generally along or parallel to a radius of the circular and cylindrical shape, and circumferentially refers to a direction that is generally along or in a similar direction as a circumference of the circular and cylindrical shape.

Figure 1:
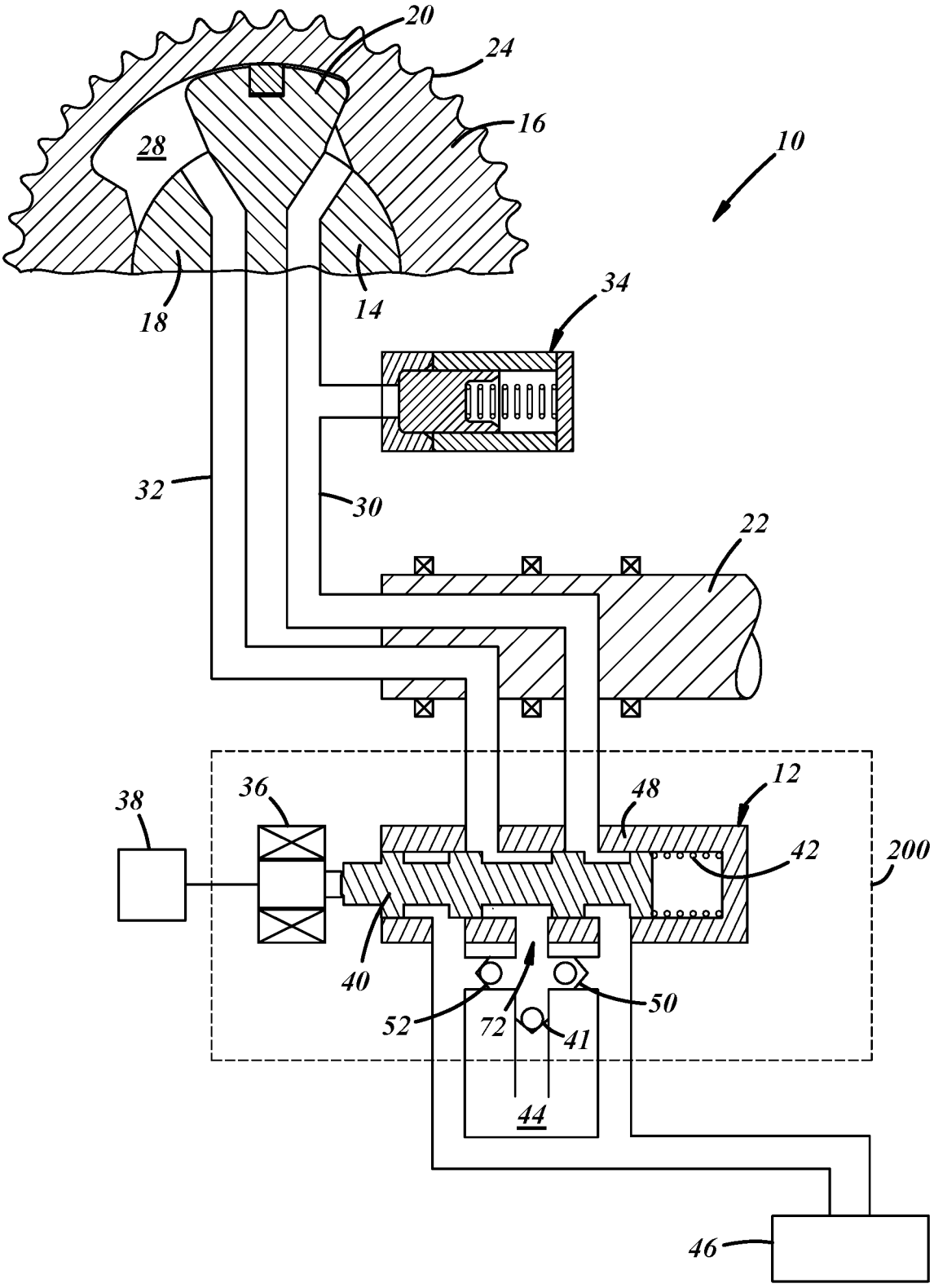
FIG. 1 is a schematic depiction of an embodiment of a variable camshaft timing (VCT) phaser assembly, showing the VCT phaser assembly in a retard state.
Figure 2:
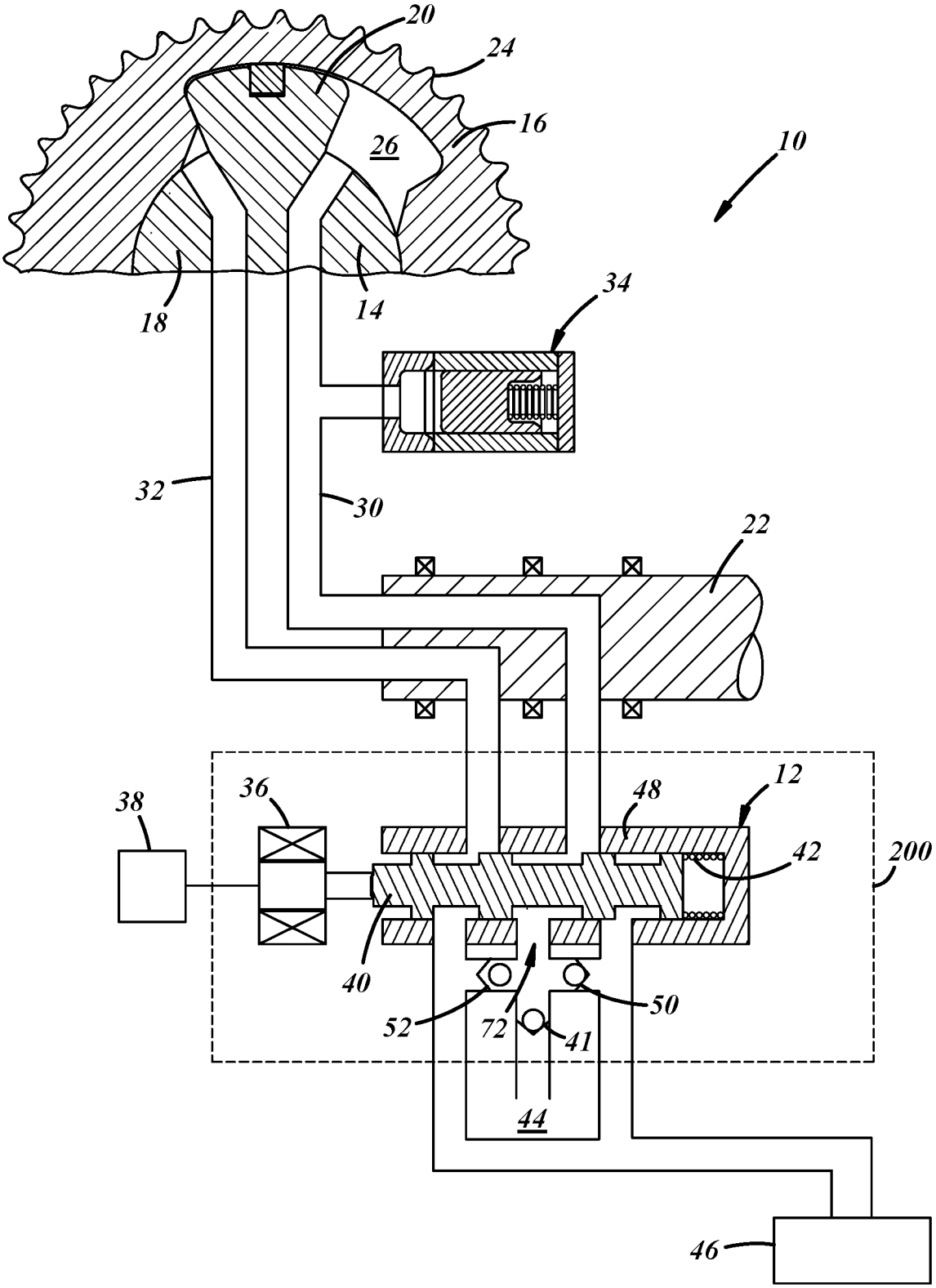
FIG. 2 is a schematic depiction of the VCT phaser assembly, showing the VCT phaser assembly in an advance state.
Figure 3:
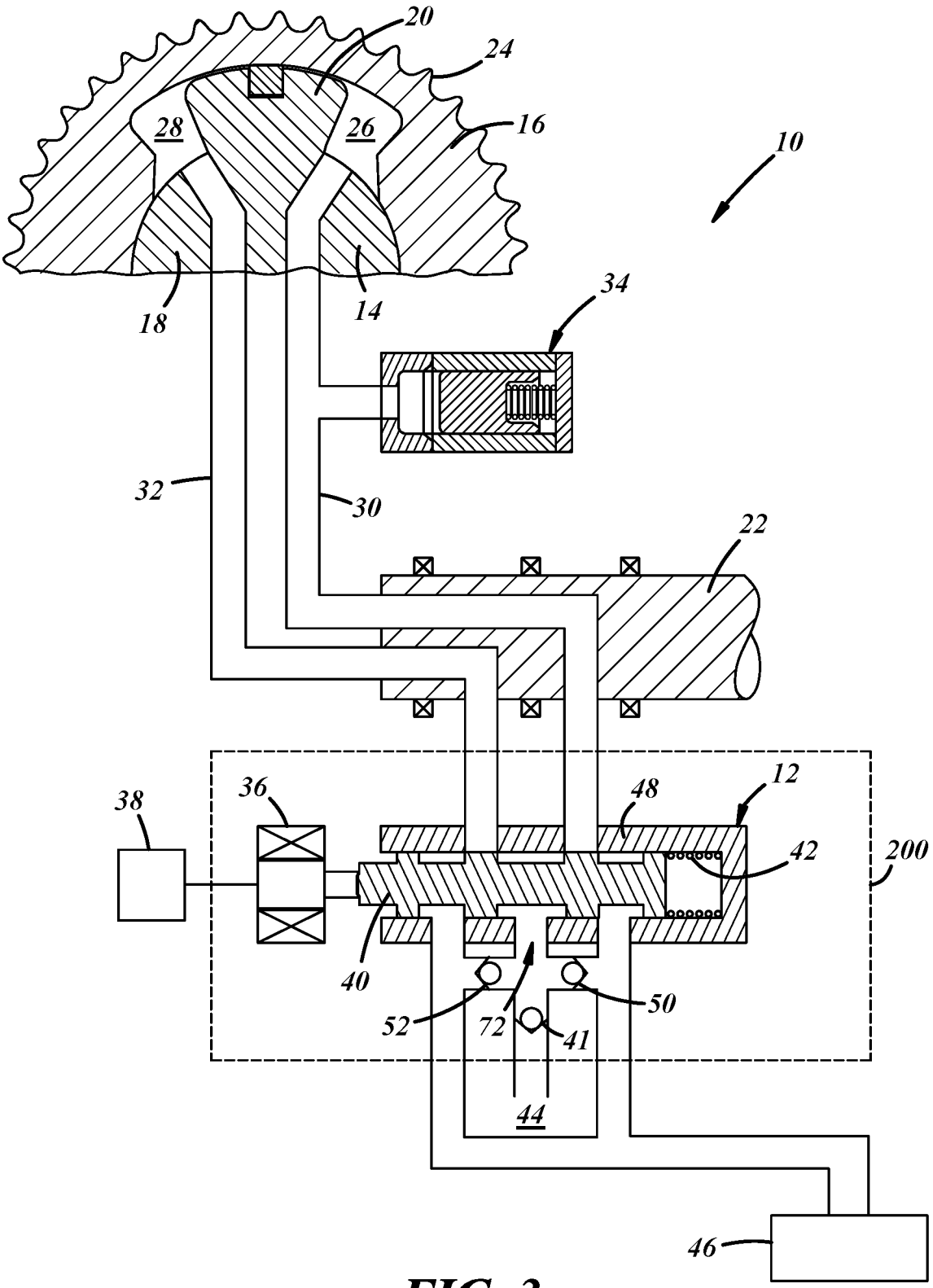
FIG. 3 is a schematic depiction of the VCT phaser assembly, showing the VCT phaser assembly in a hold state.

With reference to FIGS. 1-3, the VCT phaser assembly 10 is a hydraulically-actuated VCT phaser assembly and, in general, includes a rotor 14 and a housing 16. The rotor 14 has a hub 18 and one or more vanes 20 extending radially-outwardly from the hub 18. The rotor 14 is connected to a camshaft 22 so that rotation of the rotor 14 causes rotation of the camshaft 22. The housing 16 can have a camshaft sprocket 24 or a pulley, and partly establishes an advance fluid chamber 26 and a retard fluid chamber 28 with the rotor 14. An endless loop such as a chain or belt engages the camshaft sprocket 24 or pulley and further engages a crankshaft sprocket or other component of the accompanying ICE. By way of the engagement, rotation is transmitted from the ICE to the housing 16, causing the housing 16 to rotate as well. The vane(s) 20 occupy the advance and retard fluid chambers 26, 28, and the fluid chambers 26, 28 receive pressurized fluid via a respective advance line 30 and retard line 32 amid use of the VCT phaser assembly 10. Among its other possible components, the VCT phaser assembly 10 can further include a lock pin assembly 34, an actuator 36 such as a variable force solenoid (VFS) actuator, and a controller 38 such as an engine control unit (ECU). The lock pin assembly 34 is used to maintain the angular position of the rotor 14 with respect to the housing 16. An embodiment of the actuator 36 is described in greater detail below with reference to FIG. 5 (it is only shown schematically in FIGS. 1-3). Here, in general terms, the actuator 36 acts on a spool 40 of the VCT control valve 12 and moves the spool 40 axially and linearly against the bias of a spring 42 and as commanded by the controller 38. As also depicted schematically in FIGS. 1-3, hydraulic fluid such as oil is selectively introduced to the VCT control valve 12 via a source 44 of the accompanying ICE. The source 44 can be pressurized by a pump. And, at certain times, oil can exit the VCT control valve 12 to a sump or a tank 46 of the accompanying ICE.

While an example application of the VCT control valve 12 has now been described, the VCT control valve 12 can be employed in other applications including in other VCT phaser assemblies with different components and workings than presented in FIGS. 1-3 and described with reference thereto.

In applications in which a belt is used to engage the VCT housing in order to transmit rotation of the ICE to the VCT housing, oil from a centrally-mounted valve and larger center bolt assembly of a hydraulically-actuated VCT device can sometimes make its way to the belt. The larger center bolt assembly often includes a center bolt body, and the central mounting location is with respect to housing and rotor components of the hydraulically-actuated VCT device and is also referred to as a center bolt site herein. If the oil would make its way to the belt, the engagement and transmission of rotation between the ICE and VCT housing can be hindered. In order to keep clear of the oil and resolve these concerns, the VCT control valve 12 in the embodiment of the figures is designed and constructed for installation at a location that is somewhat remote of the rotor 14 and the housing 16. Unlike valves in many past hydraulically-actuated VCT devices, the VCT control valve 12 is not centrally-mounted relative to the rotor 14 and housing 16 and hence is not installed at the center bolt site. The VCT control valve 12 lacks a center bolt body of past valves. Instead, the VCT control valve 12 has a design and construction that facilitates its installation directly and immediately in a cylinder head of the accompanying ICE, in a component mounted to the cylinder head such as a bearing cap, in an engine block of the accompanying ICE, in a component mounted to the engine block, or elsewhere in the ICE; these installation embodiments are depicted in FIGS. 1-3 by broken line representation 200. At its remote location, the VCT control valve 12 lacks proximity to the oil of the VCT device, minimizing the risk of inadvertent and unwanted oil contact. Still, other reasons can exist for installing the VCT control valve 12 at a location that is removed from the center bolt site—for example, to reduce the overall longitudinal length of the VCT phaser assembly 10 for satisfying packaging demands in certain ICE applications which, in automotive settings, can be exacting and even inflexible.

The VCT control valve 12 helps manage the flow of oil at its remote location to and from the advance and retard fluid chambers 26, 28 in order to effect advance and retard functionalities of the VCT phaser assembly 10. The VCT control valve 12 can have various designs, constructions, and components depending on the particular ICE application in which the VCT control valve 12 is employed for use. In the embodiment of the figures, the VCT control valve 12 is designed and constructed for carrying out torsional assist (TA) and camshaft torque actuation (CTA) phasing functionalities. The VCT control valve 12, in general, includes a valve housing 48, the spool 40, an inlet check valve 41, a first recirculation check valve 50, a second recirculation check valve 52, a first recirculation path 54, a second recirculation path 56, and a remote installation structural interface 58; still, more or less and/or different components are possible in other embodiments.

With particular reference to FIGS. 6-9, in this embodiment the valve housing 48 has a body 60 that can be a one-piece structure composed of a metal material. The body 60 exhibits a generally cylindrical shape and extends in the axial direction (relative to its cylindrical shape) between a first or front end 62 and a second or rear end 64. The first end 62 is an open end, and the second end 64 has an opening 66 residing in it that can provide venting during use of the VCT control valve 12. A flange 68 is situated at the first end 62 and extends radially-outwardly therefrom. Although not presented in the figures, threads could be furnished adjacent the second end 64 for facilitating remote installation of the VCT control valve 12 via rotating movement. The flange 68 facilitates direct and immediate mounting of the actuator 36 in certain embodiments. The actuator 36 can be carried by the valve housing 48 by way of the flange 68. A bore 70 is defined at the body's interior and spans between the first and second ends 62, 64. The bore 70 accepts insertion of the spool 40.

Still referring to FIGS. 6-9, various ports and passages can reside in the valve housing 48 for the movement of oil in and out of the valve housing 48. In this embodiment, the valve housing 48 has a first port 72, a second port 74, a third port 76, a recirculation port 78, and a vent passage 80. In this embodiment, each port 72, 74, 76, 78 is designed and constructed to facilitate the flow of oil in and out of the valve housing 48 and in fluid communication with the remote installation component (e.g., the cylinder head) and in fluid communication with the advance and retard lines 30, 32. The first port 72 has fluid communication with the source 44 via a source line 45 (FIG. 4) for the introduction of oil, as needed, to the VCT control valve 12. The first port 72 is established by a first slot 82 and multiple first holes 84. The first slot 82 resides at an exterior of the valve housing's body 60 and is defined in part by a first slot outer surface 86 and wall 88. The first slot 82, in general, has a lengthwise extent that traverses a circumference of the body 60. The first holes 84 fluidly communicate with the first slot 82 and span wholly through the body 60. The first holes 84 extend to the bore 70. The first holes 84 reside within the perimeter of the first slot 82, as defined by the wall 88. As depicted perhaps best by FIG. 8, the first holes 84 are arranged in series along the lengthwise extent of the first slot 82 and in general alignment with the circumferential extent of the body 60. While there is a total of four holes in this embodiment, other quantities of holes could be provided in other embodiments.

Figure 8:
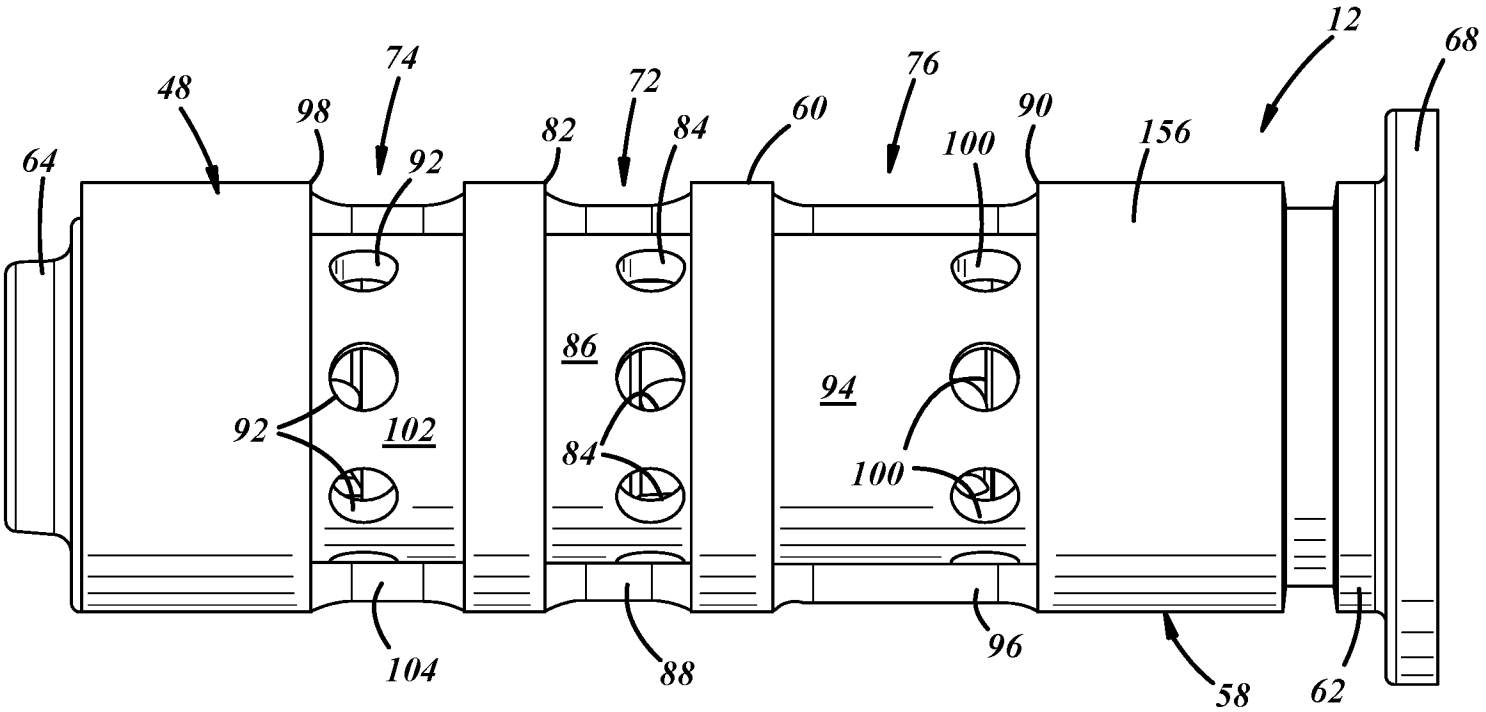
FIG. 8 is another side view of the VCT control valve.

The second port 74 has fluid communication with the advance line 30. Similar to the first port 72, the second port 74 is established by a second slot 90 and multiple second holes 92. The second slot 90 resides at the exterior of the valve housings body 60 and is defined in part by a second slot outer surface 94 and wall 96. The second slot 90, in general, has a lengthwise extent that traverses the circumference of the body 60. The second holes 92 fluidly communicate with the second slot 90 and span wholly through the body 60. The second holes 92 extend to the bore 70. The second holes 92 reside within the perimeter of the second slot 90, as defined by the wall 96. As depicted perhaps best by FIG. 8, the second holes 92 are arranged in series along the lengthwise extent of the second slot 90 and in general alignment with the circumferential extent of the body 60. While there is a total of four holes in this embodiment, other quantities of holes could be provided in other embodiments. Furthermore, the third port 76 has fluid communication with the retard line 32. Similar to the first and second ports 72, 74, the third port 76 is established by a third slot 98 and multiple holes 100. The third slot 98 resides at the exterior of the valve housing's body 60 and is defined in part by a third slot outer surface 102 and wall 104. The third slot 98, in general, has a lengthwise extent that traverses the circumference of the body 60. The third holes 100 fluidly communicate with the third slot 98 and span wholly through the body 60. The third holes 100 extend to the bore 70. The third holes 100 reside within the perimeter of the third slot 98, as defined by the wall 104. With reference to FIG. 8, the third holes 100 are arranged in series along the lengthwise extent of the third slot 98 and in general alignment with the circumferential extent of the body 60. While there is a total of four holes in this embodiment, other quantities of holes could be provided in other embodiments.

Figure 6:
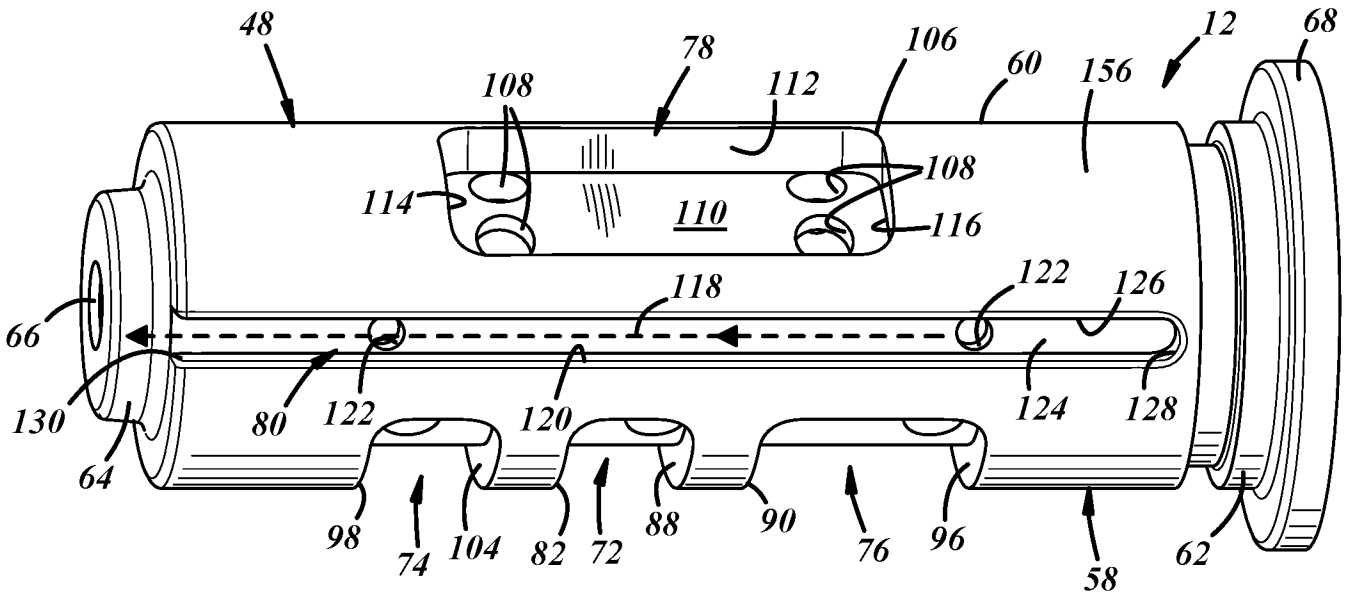
FIG. 6 is another perspective view of the VCT control valve.
Figure 7:
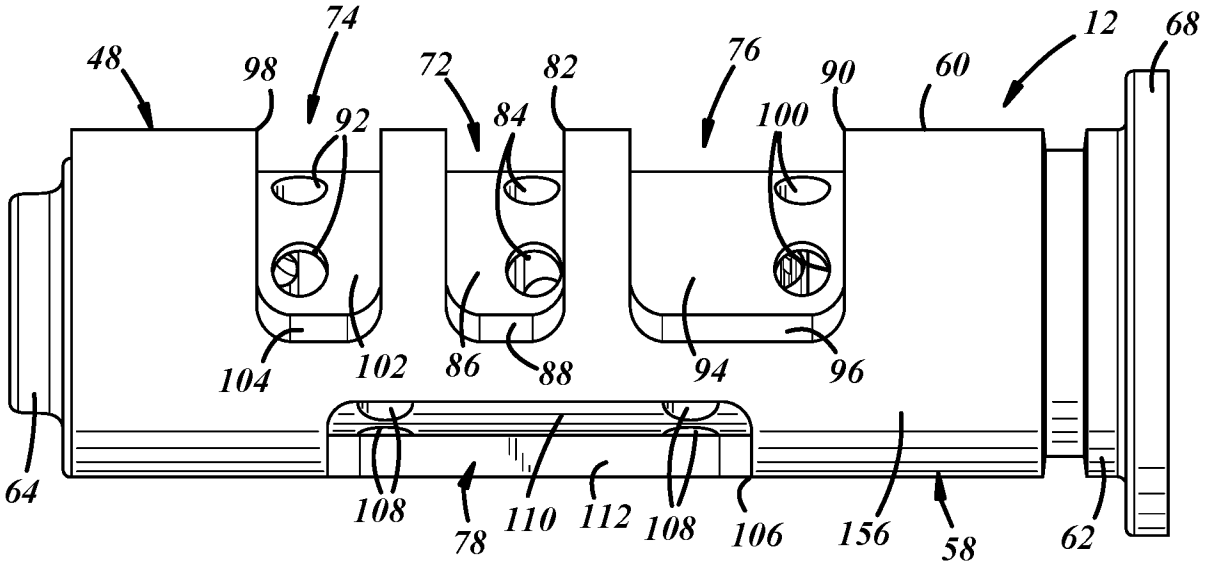
FIG. 7 is a side view of the VCT control valve.
Figure 9:
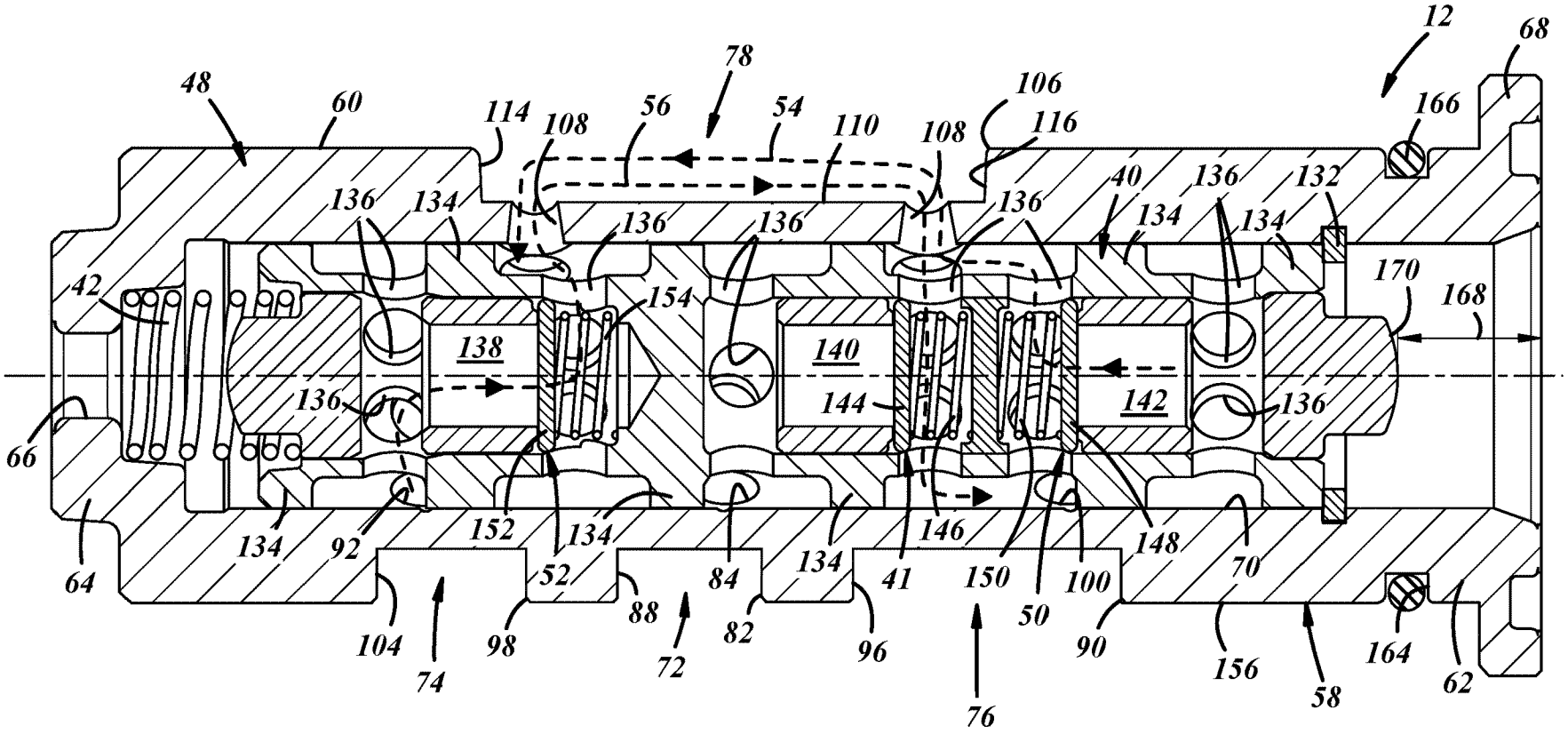
FIG. 9 is a sectional view of the VCT control valve.

The recirculation port 78 facilitates the CTA phasing functionalities of the VCT control valve 12, and accommodates oil flow via the first and second recirculation paths 54, 56. Referring now to FIGS. 6, 7, and 9, the recirculation port 78 is established by a recirculation slot 106 and multiple recirculation holes 108. The recirculation slot 106 resides at the exterior of the valve housing's body 60 and is defined in part by a recirculation slot outer surface 110 and wall 112. Unlike the previous slots described, the recirculation slot 106 has a lengthwise extent that, in general, traverses an axis of the body 60. The recirculation holes 108 fluidly communicate with the recirculation slot 106 and span wholly through the body 60. The recirculation holes 108 extend to the bore 70. The recirculation holes 108 reside within the perimeter of the recirculation slot 106, as defined by the wall 112. With particular reference to FIG. 6, in this embodiment there are a total of four recirculation holes 108; in other embodiments other quantities could be provided. Here, a first pair of the four recirculation holes 108 is located near an axial end wall 114 of the wall 112, and a second pair of the four recirculation holes 108 is located near an opposite axial end wall 116 of the wall 112. At different moments of operation of the VCT control valve 12, and depending on whether oil flow is following the first recirculation path 54 or the second recirculation path 56, the first pair of recirculation holes 108 can serve as an entry or exit of oil to or from the recirculation slot 106, while the second pair of recirculation holes 108 serves as the counter exit or entry.

With reference to FIG. 6, the vent passage 80 allows oil to vent and leave the VCT control valve 12 during use. Exiting oil follows the vent passage 80 to the sump or tank 46 of the accompanying ICE in this embodiment. An arrow 118 in FIG. 6 is a representation of the exiting oil. The vent passage 80 is established by a vent slot 120 and one or more vent holes 122. The vent slot 120 resides at the exterior of the valve housing's body 60 and is defined in part by a vent slot outer surface 124 and wall 126. The vent slot 120 has an elongated and lengthwise extent that, in general, traverses an axis of the body 60. The vent slot 120 spans substantially the full axial extent of the body 60, as illustrated in FIG. 6. At one end, the vent slot 120 has a closed end 128, and at its opposite end the vent slot 120 has an open end 130. The vent hole(s) 122 fluidly communicate with the vent slot 120 and span wholly through the body 60. The vent hole(s) 122 extend to the bore 70, and have a reduced diameter compared to the holes 84, 92, 100, 108. The vent hole(s) 122 reside within the perimeter of the vent slot 120, as defined by the wall 126. In this embodiment there are a total of two holes 122, but in other embodiments other quantities could be provided.

Referring to FIG. 9, the spool 40 is received within the valve housing 48 and is moveable axially in the bore 70 during use of the VCT control valve 12. The spring 42 biases the spool 40 toward the first end 62 of the body 60, while the actuator 36, when commanded, urges movement of the spool 40 against the bias of the spring 42. A retainer 132 halts movement of the spool 40 and keeps the spool 40 within the bore 70. The precise axial position of the spool 40 with respect to the body 60 serves to manage oil flow at the VCT control valve 12. The spool 40 can have various designs and constructions. In the embodiment presented by FIG. 9, the spool 40 has numerous lands 134 and, in between certain of the lands 134, has sets of spool holes 136. The holes 136 fluidly communicate with internal passages of the spool 40 for oil flow therethrough at certain times amid use of the VCT control valve 12. In this embodiment, the spool 40 has a first internal passage 138, a second internal passage 140, and a third internal passage 142.

Still referring to FIG. 9, the inlet check valve 41 is carried at the interior of the spool 40 adjacent the second internal passage 140, and permits and prevents oil flow at its location depending on the axial position of the spool 40 relative to the body 60 and the direction of oil flow. In this embodiment, the inlet check valve 41 permits the flow of oil downstream of the first port 72 and its holes 84 when oil is being introduced from the source 44 amid TA phasing functionalities of the VCT control valve 12. The inlet check valve 41, on the other hand, prevents the flow of oil back to first port 72 at other times such as amid CTA phasing functionalities of the VCT control valve 12. The inlet check valve 41 can take various types. Here, the inlet check valve 41 has a disc 144 and a spring 146 biasing the disc 144 to its closed position.

The first recirculation check valve 50 is carried at the interior of the spool 40 adjacent the third internal passage 124, and permits and prevents oil flow at its location depending on the axial position of the spool 40 relative to the body 60 and the direction of oil flow. In this embodiment, the first recirculation check valve 50 permits the flow of oil downstream of the third port 76 and its holes 100 when oil is being recirculated amid CTA phasing functionalities of the VCT control valve 12. Conversely, the first recirculation check valve 50 prevents the flow of oil at the third internal passage 142 at other times such as amid TA phasing functionalities of the VCT control valve 12. The first recirculation check valve 50 can take various types. Here, the first recirculation check valve 50 has a disc 148 and a spring 150 biasing the disc 148 to its closed position. In other embodiments, the first recirculation check valve 50 could be of the band check valve type.

The second recirculation check valve 52 is carried at the interior of the spool 40 adjacent the first internal passage 138, and permits and prevents oil flow at its location depending on the axial position of the spool 40 relative to the body 60 and the direction of oil flow. In this embodiment, the second recirculation check valve 52 permits the flow of oil downstream of the second port 74 and its holes 92 when oil is being recirculated amid CTA phasing functionalities of the VCT control valve 12. Conversely, the second recirculation check valve 52 prevents the flow of oil at the first internal passage 138 at other times such as amid TA phasing functionalities of the VCT control valve 12. The second recirculation check valve 52 can take various types. In FIG. 9, the second recirculation check valve 52 has a disc 152 and a spring 154 biasing the disc 152 to its closed position. In other embodiments, the second recirculation check valve 52 could be of the band check valve type.

The first recirculation path 54 can be established within the VCT control valve 12 depending upon the axial position of the spool 40 relative to the body 60. The first recirculation path 54 is represented in FIG. 9 by the arrowed broken line, but lacks specific depiction by way of the spool 40 and body 60—in other words, the first recirculation path 54 is not established when the spool 40 is positioned relative to the body 60 as it is shown in FIG. 9. Rather, the first recirculation path 54 would be established when the spool 40 is moved more toward the second end 64 relative to the body 60. Oil flows along the first recirculation path 54 amid CTA phasing functionalities of the VCT control valve 12. When established, oil travels from the third holes 100 to the third internal passage 142 via the spool holes 136 adjacent the third internal passage 142. From there, the oil travels through the opened first recirculation check valve 50, through the spool holes 136 thereat, and through the recirculation holes 108 near the axial end wall 116. The oil traverses the axial extent of the recirculation slot 106 and goes through the recirculation holes 108 near the axial end wall 114, through the spool holes 136 adjacent the closed second recirculation check valve 52, and then through the second holes 92.

The second recirculation path 56 can be established within the VCT control valve 12 depending upon the axial position of the spool 40 relative to the body 60. The numbered and arrowed broken line in FIG. 9 represents the second recirculation path 56. The second recirculation path 56 is depicted by the position of the spool 40 relative to the body 60 in FIG. 9. Oil flows along the second recirculation path 56 amid CTA phasing functionalities of the VCT control valve 12. When established, oil travels from the second holes 92 to the first internal passage 138 via the spool holes 136 adjacent the first internal passage 138. From there, the oil travels through the opened second recirculation check valve 52, through the spool holes 136 thereat, and through the recirculation holes 108 near the axial end wall 114. The oil traverses the axial extent of the recirculation slot 106 and goes through the recirculation holes 108 near the axial end wall 116, through the spool holes 136 adjacent the closed valves 41, 50, and then through the third holes 100.

Figure 4:
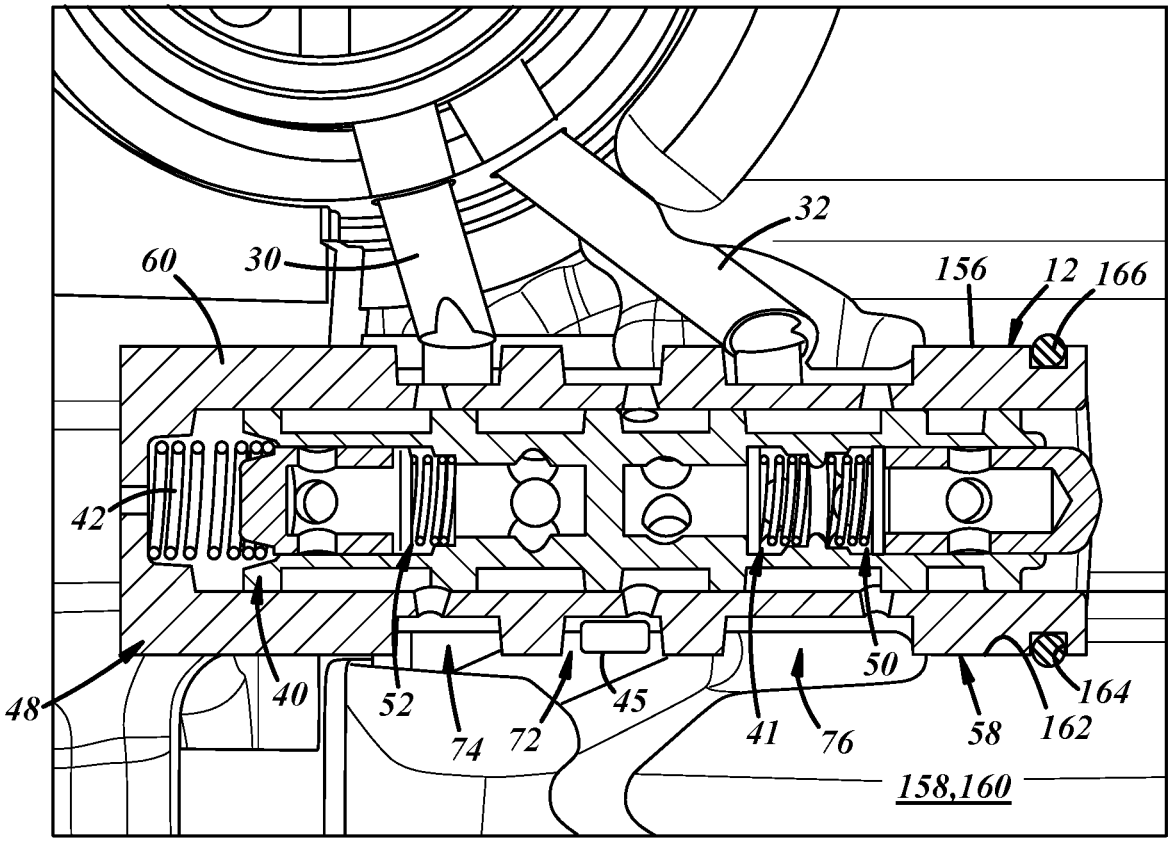
FIG. 4 depicts an embodiment of a VCT control valve that can be used with the VCT phaser assembly.
Figure 5:
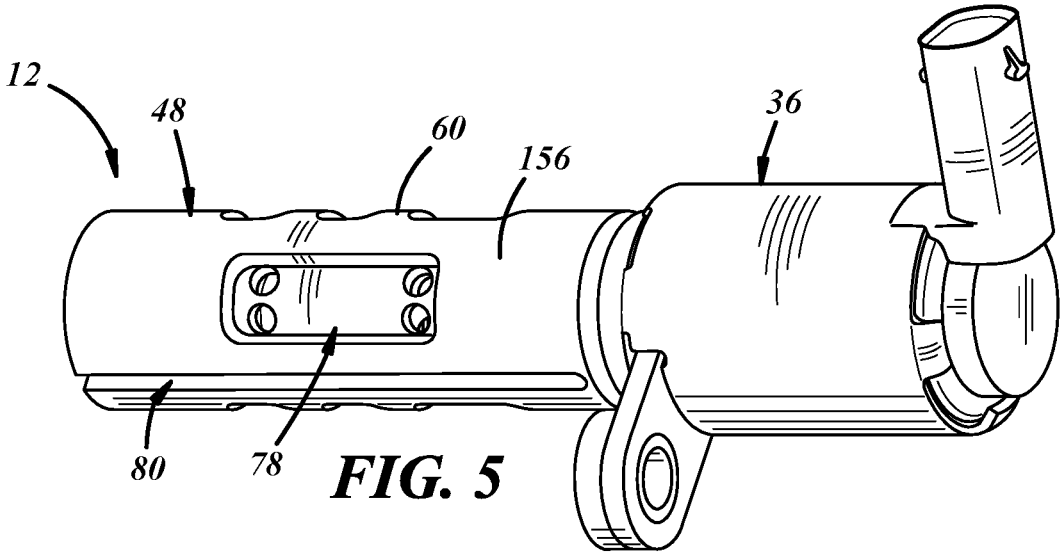
FIG. 5 is a perspective view of the VCT control valve, showing an embodiment of an actuator mounted thereon.

The remote installation structural interface 58 facilitates installation of the VCT control valve 12 at a location in the accompanying ICE that is remote of the rotor 14 and the housing 16. As set forth above, this location can be in the ICE's cylinder head, in a component mounted to the cylinder head, in the ICE's engine block, or in a component mounted to the engine block. The remote installation structural interface 58 resides at the body's exterior and, in this embodiment, is partly constituted by an exterior surface 156 of the body 60 that opposes and directly confronts surfaces of an engine structure 158 such as an engine block 160, as depicted in FIG. 4. In this embodiment, the VCT control valve 12 is inserted and received in a cavity 162 residing in the engine block 160. To prevent oil leakage, in this embodiment the remote installation structural interface 58 includes a groove 164 and an o-ring seal 166 seated in the groove 164. Due in part to the remote installation of the VCT control valve 12, and as previously set forth, the actuator 36 has a direct mounting to the body 60. This is depicted in FIG. 5. Yet in other embodiments, the actuator 36 need not be directly mounted to the body 60. With reference now to FIG. 9, in order to accommodate the direct mounting of the actuator 36 and its action on the spool 40 to prompt movement thereof, a clearance 168 resides between the spool 40 and the first end 62. The clearance 168 is defined in the axial direction between a terminal end 170 of the spool 40 and the first end 62 of the body 60. The actuator 36 can be of the linear or rotary type, depending on the embodiment. Furthermore, and also due in part to the remote installation of the VCT control valve 12, the advance and retard lines 30, 32 in this embodiment span through the camshaft 22. This is depicted schematically by FIGS. 1-3.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A variable camshaft timing (VCT) phaser assembly, comprising:

a housing and a rotor situated within the housing, at least one advance chamber and at least one retard chamber establishable between the housing and the rotor; and a control valve comprising:

a valve housing having a first port residing therein for fluid communication with a source, the valve housing having a second port residing therein for fluid communication with an advance line, and the valve housing having a third port residing therein for fluid communication with a retard line;

a spool located within a bore of the valve housing and moveable within the bore;

a first recirculation path establishable between the valve housing and the spool depending upon the position of the spool in the bore of the valve housing;

a second recirculation path establishable between the valve housing and the spool depending upon the position of the spool in the bore of the valve housing; and a remote installation structural interface residing at an exterior of the valve housing for facilitating installation of the control valve at a location of an engine structure and removed from the housing and rotor of the VCT phaser assembly;

wherein the bore spans between the end of the valve housing and another opposite end of the valve housing, the spool extends between a first end and a second end, the first and second ends of the spool remain axially inboard of the end and opposite end of the bore amid movement of the spool within the bore, and a clearance is maintained in an axial direction between the first end of the spool and the end of the valve housing in order to facilitate the direct mounting of the actuator on the end of the valve housing.

2. The variable camshaft timing (VCT) phaser assembly as set forth in claim 1, further comprising an actuator engaging the spool for movement of the spool within the bore of the valve housing, the actuator having a direct mounting on an end of the valve housing.

3. The variable camshaft timing (VCT) phaser assembly as set forth in claim 2, wherein the valve housing has a flange located adjacent or at the end of the valve housing, the flange facilitating the direct mounting of the actuator on the end of the valve housing.

4. The variable camshaft timing (VCT) phaser assembly as set forth in claim 1, wherein the first port is established by a first slot and a plurality of first holes in fluid communication with each other, the second port is established by a second slot and a plurality of second holes in fluid communication with each other, and the third port is established by a third slot and a plurality of third holes in fluid communication with each other.

5. The variable camshaft timing (VCT) phaser assembly as set forth in claim 4, wherein the first slot resides at the exterior of the valve housing and is defined at least in part by a first slot outer surface of the valve housing and an opposing surface of the engine structure, the second slot resides at the exterior of the valve housing and is defined at least in part by a second slot outer surface of the valve housing and the opposing surface of the engine structure, and the third slot resides at the exterior of the valve housing and is defined at least in part by a third slot outer surface of the valve housing.

6. The variable camshaft timing (VCT) phaser assembly as set forth in claim 1, wherein the first recirculation path is defined in part by a recirculation slot and a plurality of recirculation holes in fluid communication with each other, the recirculation slot resides at the exterior of the valve housing, and the second recirculation path is defined in part by the recirculation slot and the plurality of recirculation holes.

7. The variable camshaft timing (VCT) phaser assembly as set forth in claim 1, wherein the control valve further comprises at least one recirculation check valve situated at the spool.

8. The variable camshaft timing (VCT) phaser assembly as set forth in claim 1, wherein the control valve further comprises a vent passage established by a vent slot and at least one vent hole in fluid communication with each other, and the vent slot resides at the exterior surface of the valve housing.

9. The variable camshaft timing (VCT) phaser assembly as set forth in claim 1, wherein the remote installation structural interface includes a groove residing at the exterior of the valve housing and an o-ring seal seated in the groove.

10. The variable camshaft timing (VCT) phaser assembly as set forth in claim 1, wherein the control valve lacks a center bolt body.

11. The variable camshaft timing (VCT) phaser assembly as set forth in claim 1, wherein the engine structure is a cylinder head, an engine block, or an engine component mounted to the cylinder head or mounted to the engine block.

12. A variable camshaft timing (VCT) control valve, comprising:

a valve housing having a first slot and a plurality of first holes in fluid communication with each other, the first slot residing at an exterior of the valve housing, the valve housing having a second slot and a plurality of second holes in fluid communication with each other, the second slot residing at the exterior of the valve housing, the valve housing having a third slot and a plurality of third holes in fluid communication with each other, the third slot residing at the exterior of the valve housing, and the valve housing having a recirculation slot and a plurality of recirculation holes in fluid communication with each other, the recirculation slot residing at the exterior of the valve housing;

a spool located within a bore of the valve housing;

at least one recirculation check valve situated at the spool; and a remote installation structural interface residing at the exterior of the valve housing for facilitating installation of the VCT control valve at a location apart from a center bolt site of a VCT housing and VCT rotor, the remote installation structural interface including a seal situated at the exterior of the valve housing;

wherein the valve housing has a vent slot and a plurality of vent holes in fluid communication with each other, the vent slot residing at the exterior of the valve housing and defined in part by a vent slot outer surface and wall.

13. The variable camshaft timing (VCT) control valve as set forth in claim 12, wherein the first slot, the second slot, the third slot, and the recirculation slot confront at least one engine structure adjacent the exterior of the valve housing.

14. A variable camshaft timing (VCT) phaser assembly comprising the VCT control valve of claim 12 and further comprising an actuator carried by an end of the valve housing.

15. A variable camshaft timing (VCT) phaser assembly as set forth in claim 14, wherein the actuator is carried by a flange at the end of the valve housing.

16. A variable camshaft timing (VCT) phaser assembly, comprising:

a housing and a rotor;

a control valve comprising:

a valve housing having a first port residing therein for fluid communication with a source, the valve housing having a second port residing therein for fluid communication with an advance line, and the valve housing having a third port residing therein for fluid communication with a retard line;

a spool located within a bore of the valve housing and moveable within the bore;

at least one recirculation check valve situated at the spool;

at least one recirculation path establishable between the valve housing and the spool depending upon the position of the spool in the bore of the valve housing;

a remote installation structural interface residing at an exterior of the valve housing for facilitating installation of the control valve at a location of an engine structure; and a vent passage established by a vent slot and at least one vent hole in fluid communication with each other, and the vent slot resides at the exterior surface of the valve housing and has a lengthwise extent that generally traverses an axis of a body of the valve housing at the exterior surface of the valve housing;

an actuator engaging the spool to effect movement of the spool within the bore of the valve housing, the actuator having a direct mounting on an end of the valve housing.

17. The variable camshaft timing (VCT) phaser assembly as set forth in claim 16, wherein the first port is established at least in part by a first slot residing at the exterior of the valve housing, the second port is established at least in part by a second slot residing at the exterior of the valve housing, and the third port is established at least in part by a third slot residing at the exterior of the valve housing.

18. The variable camshaft timing (VCT) phaser assembly as set forth in claim 17, wherein the at least one recirculation path is defined at least in part by a recirculation slot residing at the exterior of the valve housing.

* * * * *